United States Patent [19]

Welsh

[11] 4,149,299

[45] Apr. 17, 1979

[54] CLAMP FOR CLOSING BAG

[75] Inventor: Aaron L. Welsh, Warner Robins, Ga.

[73] Assignee: Virgil J. Holman, Macon, Ga. ; a part interest

[21] Appl. No.: 867,236

[22] Filed: Jan. 6, 1978

[51] Int. Cl.[2] ..... A44B 21/00

[52] U.S. Cl. ..... 24/30.5 S; 24/138; 24/243 B; 24/255 R; 24/258

[58] Field of Search ..... 24/30.5 R, 30.5 S, 30.5 L, 24/255 R, 255 SL, 137 R, 138 R, 248 B, 258, 250, 243 B

[56] References Cited

U.S. PATENT DOCUMENTS

| | | | |
|---|---|---|---|
| 2,519,987 | 8/1950 | Wernette | 24/255 R |
| 2,910,753 | 11/1959 | Carbauh | 24/138 R |
| 3,141,212 | 7/1964 | Coffey | 24/138 R |
| 3,405,429 | 10/1968 | Vazquez | 24/137 R |

FOREIGN PATENT DOCUMENTS

| | | | |
|---|---|---|---|
| 49827 | 4/1911 | Fed. Rep. of Germany | 24/250 |
| 165200 | 11/1958 | Sweden | 24/137 R |

*Primary Examiner*—Kenneth J. Dorner
*Attorney, Agent, or Firm*—Clarence A. O'Brien; Harvey B. Jacobson

[57] ABSTRACT

A body is provided constructed of shape retentive but at least slightly bendable and resilient material. The body includes generally parallel elongated side-by-side levers defining pairs of corresponding first and second end portions and a first connecting portion integral with, extending between and connecting one pair of end portions. A second connecting portion of generally C-shaped configuration and including a pair of opposed arm portions and a bight portion connecting one pair of corresponding ends of the arm portions is also provided and the second connecting portion extends between the levers with the free ends of the arm portions formed integrally with the levers and the second connecting portion opening away from the first pair of end portions of the levers and toward the other pair of end portions thereof. The levers include generally parallel opposing portions spaced slightly from the second connecting portion toward the other pair of end portions of the levers at least closely opposing each other and defining a passage therebetween leading, in a direction extending toward said one pair of end portions of said levers, into a pocket defined by the second connecting portion opening outwardly through the passage. The other pair of end portions of the levers are manually displaceable away from each other to widen the passage in order to receive the closed neck of a flexible bag therethrough.

11 Claims, 4 Drawing Figures

CLAMP FOR CLOSING BAG

BACKGROUND OF THE INVENTION

Various forms of clamps have been provided for closing sacks and bags and for also clampingly engaging other articles. However, these previously known forms of clamps are not constructed in a manner whereby the closed neck of a flexible bag or sack may be readily moved into and removed from clamping engagement by the clamp. Accordingly, a need exists for a clamp for clamping the open end of a sack or bag closed and which is constructed in a manner whereby the associated bag or clamp may be readily moved into position clampingly closed by the clamp and readily removed from engagement with the clamp for ease of access into the bag or sack.

Examples of various forms of previously patented clamps including some of the structural and operational features of the instant invention are disclosed in U.S. Pat. Nos. 2,628,396, 2,931,086, 2,988,314, 3,405,429, 3,733,656, 3,760,463, 3,485,521 and 3,982,307.

BRIEF DESCRIPTION OF THE INVENTION

The clamp of the instant invention comprises a pair of lever members interconnected by means of a first integral shape retentive but at least slightly bendable and resilient connecting portion extending between one pair of corresponding end portions of the levers. The other pair of corresponding end portions of the levers diverge away from each other and are disposed in at least close juxtaposition adjacent their convergent portions and define a passage between the closely juxtaposition portions of the lever members and the first connecting portion defines a pocket opening outwardly between the closely juxtaposition portions of the levers toward the other pair of corresponding end portions thereof. In addition, structure is connected between the levers biasing the closely juxtaposition portions of the levers toward each other.

The main object of this invention is to provide a clamp for readily removably securing the open end of a bag or sack closed.

Yet another object of this invention is to provide a clamp in accordance with the preceding object and constructed in a manner whereby it may be readily operatively engaged with a bag or sack to be closed.

Still another object of this invention is to provide a clamp in accordance with the immediately preceding objects and constructed whereby the associated bag or sack closed by the clamp may be readily disengaged therefrom.

Yet another object of this invention is to provide a clamp of one piece construction.

A final object of this invention to be specifically enumerated herein is to provide a clamp in accordance with the preceding objects and which will conform to conventional forms of manufacture, be of simple construction and easy to use so as to provide a device that will be economically feasible, long lasting and relatively trouble free in cooperation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
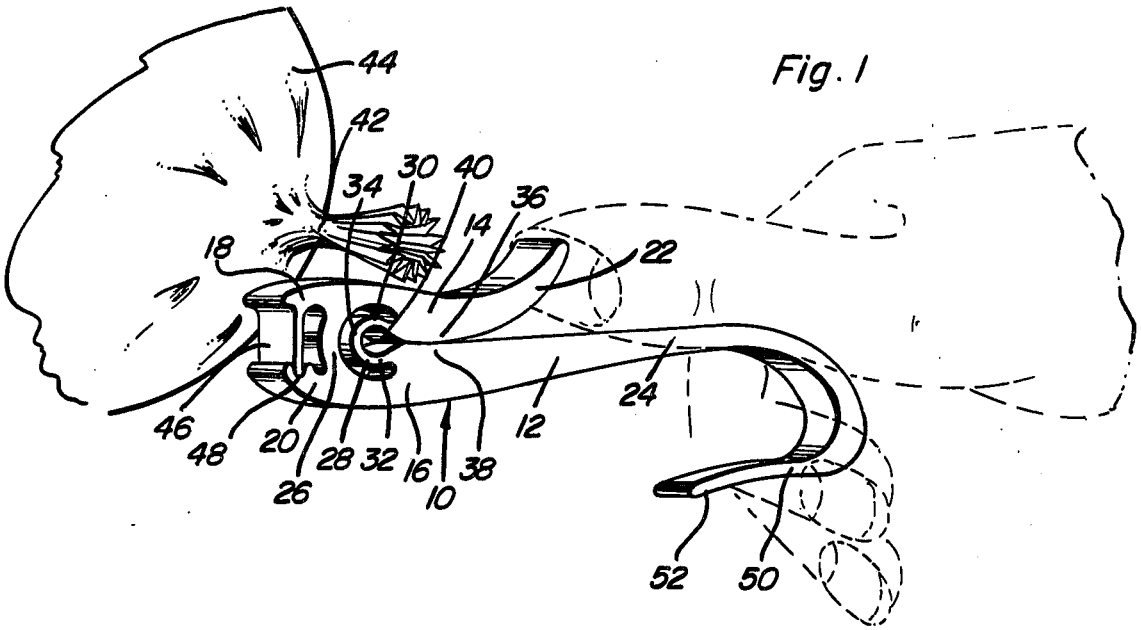
FIG. 1 is a perspective view of a first form of clamp constructed in accordance with the present invention and positioned closely adjacent the open end of a bag to be removably clamped closed by means of the clamp.

Referring now more specifically to the drawings, the numeral 10 generally designates the first form of clamp constructed in accordance with the present invention. The clamp 10 includes a one-piece body 12 constructed of shape retentive but at least slightly bendable and resilient material such as plastic. The body 12 includes a pair of generally parallel elongated side-by-side levers 14 and 16 defining pairs of corresponding first and second opposite end portions 18, 20 and 22, 24. A first connecting portion 26 formed integrally with the lever members 14 and 16 extends between and connects the end portions 18 and 20 at points spaced therealong from the free terminal ends thereof. A second connecting portion 28 of generally C-shaped configuration and including a pair of opposed arm portions 30 and 32 and a bight portion 34 connecting one pair of corresponding ends of the arm portions 30 and 32 is provided and the second connecting portion 28 is also formed integrally with the lever members 14 and 16 with the free ends of the arm portions 30 and 32 joined to the lever members 14 and 16 at points spaced therealong from the first connecting portion 26 toward the other pair of end portions 22, 24 of the levers 14 and 16. The second connecting portion 28 opens away from the end portions 18, 20 toward the end portions 22, 24 and the levers 14 and 16 include generally parallel opposing portions 36 and 38 spaced slightly from the second connecting portion 28 toward the other pair of end portions 22, 24 of the levers 14 and 16 closely opposing each other and defining a passage therebetween leading, in a direction extending toward said one pair of end portions 18, 20, into the pocket 40 defined by the second connecting portion 28. The pocket 40 opens outwardly from the second connecting portion 28 through the passage defined between the opposing portions 36 and 38 and the other pair of end portions 22, 24 of the levers 14 and 16 may be manually displaced away from each other to widen the aforementioned passage in order to receive the closed neck 42 of a flexible bag or sack 44 therein.

The opposing surfaces of the second connecting portion extending toward the closely juxtaposed portions 36 and 38 converge toward each other and thus define cam surfaces to facilitate removal of the neck 42 of the bag or sack 44 from the pocket 40 between the portions 36 and 38. In addition, the opposing surfaces of the end portions 22, 24 of levers 14 and 16 extending toward the portions 36 and 38 on the side thereof remote from the pocket 40 also converge toward each other and define cam surfaces between which the closed neck 42 of the bag or sack 44 may be wedged in order to spread the end portions 22, 24 apart to widen the passage between the portions 36 and 38 for receiving the closed neck 42 therethrough.

When forming the clamp 10 out of plastic or other similar material by a molding process, it is necessary that the portions 36 and 38 be spaced apart during the molding process in order to prevent them from being molded integral with each other. Accordingly, the end portion 18 includes an integral tongue or tab 46 extending therefrom toward the end portion 20 and the latter includes a transverse groove 48 opening toward the end portion 18 and in which the free end of the tab 46 is receivable in order to flex the first connecting portion 26 and relatively angularly displace the levers 14 and 16 to positions with the portions 36 and 38 contacting each other. Actually, the end portions 18, 20 between the first connecting portion 26 and the tongue or tab 46 are spread apart causing flexure of the end portions 18 and 20 by engagement of the tongue or tab 46 in the groove 48.

The end portion 22 of the lever 14 curves away from the end portion 24 of the lever 16 and the free end of the end portion 24 includes a reversely bent portion 50 on the side thereof remote from the end portion 22 and which curves slightly away from the end portion 24 at its free terminal end 52. Accordingly, the clamp 10 may be gripped in the manner illustrated in phantom lines in FIG. 1 of the drawings by the right hand of the user of the clamp with the forefinger of the user engaged in the reversely bent portion 50 and the thumb of the user engaged beneath the side of the end portion 22 opposing the end portion 24 whereby thumb pressure may be applied to the end portion 22 in order to yieldingly bias the latter away from the end portion 24 and to thus widen passage between the closely juxtaposed portions 36 and 38 in order to facilitate removal of the neck 42 of the bag 44 from the pocket 40.

Figure 2:
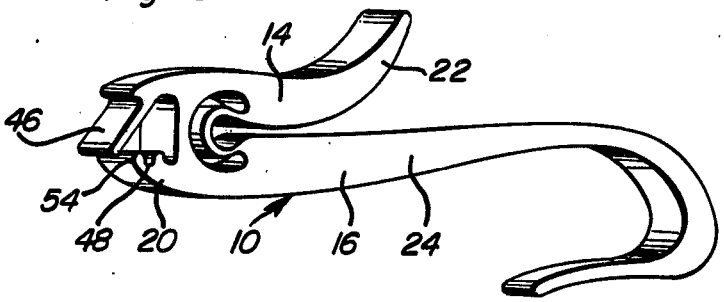
FIG. 2 is a perspective view of the clamp illustrated in FIG. 1 with the lever biasing portion thereof in an inoperative position as it would be upon initial removal of the clamp from a mold in which the clamp is formed.

FIG. 2 of the drawings illustrates the condition of the clamp 10 as it is removed from the mold in which it is formed with the tongue or tab 46 out of seated engagement in the groove 48. In order to swing the tab or tongue 46 into position with the free end thereof seated in the groove 48, the end portions 22 and 24 of the levers 14 and 16 are urged toward each other and upward and inward pressure is applied to the free end of the tongue or tab 46 as illustrated in FIG. 2 of the drawings in order to swing the free end of the tab 46 over the lip 54 defined on the end portion 20 of the lever 16 outwardly of the groove 48 for seating engagement of the free end of the tongue or tab 46 in the groove 48.

Figure 3:
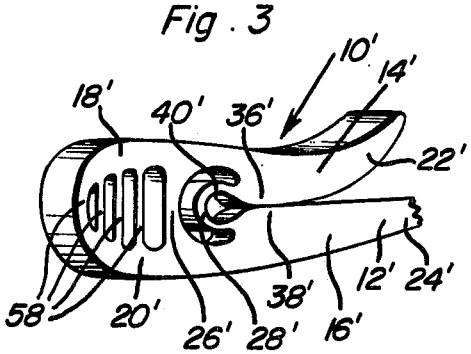
FIG. 3 is a fragmentary perspective view of a second form of clamp including a modified form of lever member biasing portion formed integrally with both of the lever members of the clamp.

With attention now invited more specifically to FIG. 3 of the drawings, there may be seen a second form of clamp referred to in general by the reference numeral 10' and which is generally similar in construction to the clamp 10 and therefore has corresponding components thereof designated by prime reference numerals corresponding to those utilized to designate similar components of the clamp 10. The clamp 10' differs from the clamp 10 in that the third connecting means extending between the levers 14 and 16 comprises a plurality of integral bar portions 58 extending between the end portions 18' and 20' on the side of the first connecting portion 26' remote from the second connecting portion 28'. The bar portions 58 are spaced longitudinally of the levers 14' and 16' and are integrally formed with each lever member. When the clamp 10' is formed by a molding process, the closely juxtaposed portions 36' and 38' are also in spaced relation. However, either just before the clamp 10' is removed from the corresponding mold or immediately after it is removed from the corresponding mold, the bar portions 58 are quickly cooled in order to stiffen the same and the inherent tendency of the plastic (polypropylene) of which the clamp 10' is constructed to shrink causes the first connecting portion 26' to shrink as the clamp 10' further cools thereby causing relative angular displacement of the levers 14' and 16' to swing the closely juxtaposed portions 36' and 38' together. Therefore, after the bar portions 58 have been quickly cooled and the remainder of the clamp 10' has been allowed to slowly cool after removal from the associated mold, the closely juxtaposed portions 36' and 38' are swung into tight engagement with each other, thereby requiring that the end portions 22' and 24' of the levers 14' and 16' be spread apart in order to enable the end 42 of the bag or sack 44 to be passed between the end portions 22' and 24' into the pocket 40'.

Figure 4:
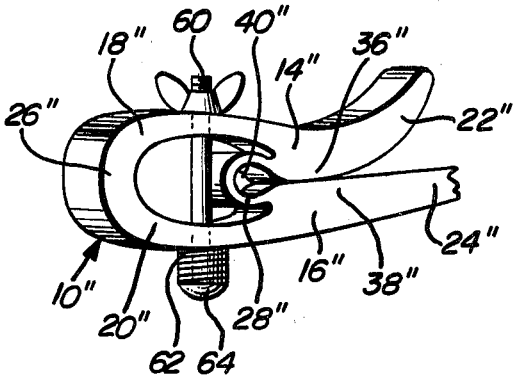
FIG. 4 is a fragmentary perspective view of a third form of clamp constructed in accordance with the present invention and utilizing an adjustable length connecting member extending between the lever members of the clamp in order to yieldingly bias the bag clamping portions thereof together.

With reference now more specifically to FIG. 4 of the drawings, there will be seen a second modified form of clamp referred to in general by the reference numeral 10" and which is also similar to the clamp 10 and therefore has the components thereof corresponding to the various components of the clamp 10 designated by corresponding double prime reference numerals.

The clamp 10" differs from the clamp 10 in that the first connecting portion 26" thereof is formed integrally with and extends between the terminal ends of the end portions 18" and 20" of the levers 14" and 16". The second connecting portion 28" corresponds to the second connecting portion 28 and an adjustable length connecting member 60 extends between and is secured through the lever members 14" and 16" on the side of the second connecting member or portion 28 remote from the end portions 22", 24" of the levers 14" and 16". The adjustable length fastener 60 has a coiled compression spring 62 encircled about one end portion thereof provided with a head 64 and the compression spring acts between the head 64 and the opposing surface of the end portion 20" to yieldingly bias the levers 14" and 16" toward positions with the closely juxtaposed portions 36" and 38" tightly engaged with each other.

It is believed to be apparent that the overall operation of the clamps 10' and 10" is substantially identical to the operation of the clamp 10.

It is believed readily apparent that the clamps 10, 10' and 10" may be utilized to removably close the open ends of various forms of bags and sacks. Primarily, the clamps are designed to be removable closures for bread bags, potato bags and rice bags or sacks. In addition, the reversely bent end portion 50 of the clamp 10', corresponding reversely bent end portions being provided on the levers 24' and 24" of the clamps 10' and 10", may be utilized, in addition to a handgrip, as a hook from which the clamps may be suspended together with the bags closed and supported thereby. The pockets 40, 40' and 40" sufficiently tightly grip the ends 42 of the bags 44 in order to provide ample friction between the bags 44 and the clamps whereby the bags 44 may be supported from the clamps.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A clamp for closing the open end of a bag, said clamp including a body constructed of shape retentive but at least slightly bendable and resilient material, said body including generally parallel elongated side-by-side levers defining pairs of corresponding first and second opposite end portions, said body including a first connecting portion integral with, extending between and connecting one pair of said opposite end portions, a second connecting portion of generally C-shaped configuration and including a pair of opposed arm portions and a bight portion connecting one pair of corresponding ends of said arm portions, said second connecting portion extending between said levers with the other pair of ends of said arm portions formed integrally with said levers and said second connecting portion opening away from said first pair of end portions of said levers toward said second pair of end portions of said levers, said levers including generally parallel opposing portions spaced slightly from said second connecting portion toward said second pair of end portions of said levers at least closely opposing each other and defining a passage therebetween leading, in a direction extending toward said first pair of end portions of said levers, into a pocket defined by said second connecting portion opening outwardly through said passage, said second pair of end portions of said levers being manually displaceable away from each other to widen said passage in order to receive an open end of a flexible bag therethrough, the end of said passage remote from said pocket flaring outwardly, the second end portions of said levers defining, on one of said levers, an outwardly curving terminal end curving away from the other lever and, on the other lever, an extended portion projecting outwardly beyond said terminal end and including an integral out and back turned terminal end on the side of said other lever remote from said one lever and defining a hook for receiving the side of one hand of a user remote from the thumb of that hand.

2. The combination of claim 1 wherein the opposing surfaces of said second pair of ends of said levers are convergent toward the adjacent end of said passage and define cam surfaces between which a closed neck of a flexible bag may be wedged toward said pocket in order to spread said second pair of ends of said lever to widen said passage in order to receive said neck therethrough.

3. The combination of claim 1 wherein the ends of said arm portions adjacent said second pair of end portions of said levers converge toward each other and define cam surfaces between which a closed neck of a flexible bag may be wedged toward the last mentioned end portions in order to spread said second pair of ends of said levers to widen said passage to receive said neck therethrough.

4. The combination of claim 3 wherein the opposing surfaces of said levers are convergent toward the adjacent end of said passage and define cam surfaces between which a closed neck of a flexible bag may be wedged toward said pocket in order to spread said second pair of ends of said levers to widen said passage in order to receive said neck therethrough.

5. The combination of claim 1 wherein the second end portion of one of said levers includes a reversely curved free end portion on the side of said one lever remote from the other lever second end portion.

6. The combination of claim 5 wherein the second end portion of said other lever curves smoothly away from said second end portion of said one lever.

7. A clamp for closing the open end of a bag, said clamp including a body constructed of shape retentive but at least slightly bendable and resilient material, said body including generally parallel elongated side-by-side levers defining pairs of corresponding first and second opposite end portions, said body including a first connecting portion integral with, extending between and connecting one pair of said opposite end portions, a second connecting portion of generally C-shaped configuration and including a pair of opposed arm portions and a bight portion connecting one pair of corresponding ends of said arm portions, said second connecting portion extending between said levers with the other pair of ends of said arm portions formed integrally with said levers and said second connecting portion opening away from said one pair of end portions of said levers toward the other pair of end portions of said levers, said levers including generally parallel opposing portions spaced slightly from said second connecting portion toward said other pair of end portions of said levers at least closely opposing each other and defining a passage therebetween leading, in a direction extending toward said one pair of end portions of said levers, into a pocket defined by said second connecting portion opening outwardly through said passage, said other pair of end portions of said levers being manually displaceable away from each other to widen said passage in order to receive the open end of a flexible bag therethrough, and third means connected between said levers biasing said other pair of end portions of said levers toward each other.

8. The combination of claim 7 wherein said third connecting means comprises an adjustable length connecting member connected between said levers on the side of said second connecting means remote from said other pair of end portions of said levers.

9. The combination of claim 7 wherein said third connecting means is operably connected between said levers on the side of said first connecting means remote from the said other pair of end portions of said levers.

10. The combination of claim 9 wherein said third connecting means is formed integrally with one of said lever first end portions and is abutted against the second lever first end portion.

11. The combination of claim 9 wherein said third connecting means is formed integrally, directly, with both of said lever first end portions.

* * * * *